US007588470B2

(12) United States Patent
Li et al.

(10) Patent No.: US 7,588,470 B2
(45) Date of Patent: Sep. 15, 2009

(54) ELECTRICAL CONNECTOR WITH AN IMPROVED DETECTING PIN

(75) Inventors: Gang Li, Kunshan (CN); Bao-Shan Zhou, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/284,281

(22) Filed: Sep. 18, 2008

(65) Prior Publication Data

US 2009/0075517 A1 Mar. 19, 2009

(30) Foreign Application Priority Data

Sep. 18, 2007 (CN) ..... 2007 2 0046652

(51) Int. Cl.
*H01R 24/00* (2006.01)

(52) U.S. Cl. ..... 439/660

(58) Field of Classification Search ..... 439/660, 439/188, 607, 489; 200/51.1
See application file for complete search history.

(56) References Cited

U.S. PATENT DOCUMENTS 5,674,085 A 10/1997 Davis et al.
5,800,192 A 9/1998 David et al.
7,207,819 B2 * 4/2007 Chen ..... 439/188
7,413,467 B1 * 8/2008 Lai et al. ..... 439/489

FOREIGN PATENT DOCUMENTS

| | | |
|---|---|---|
| TW | 497768 | 8/2002 |
| TW | M288046 | 2/2006 |
| TW | M318233 | 9/2007 |

* cited by examiner

*Primary Examiner*—Phuong K Dinh
(74) *Attorney, Agent, or Firm*—Wei Te Chung

(57) ABSTRACT

An electrical connector includes an insulating housing defining a base portion and a tongue portion extending forwards from a front face of the base portion, a plurality of terminals, a shielding shell and a detect pin. Each contact defines a solder portion extending towards a bottom face of the base portion and a contacting portion located on a first surface of the tongue portion. The shielding shell surrounds the insulating housing and forms a receiving cavity for being inserted by a counter connector with an insulating tongue portion and a shielding member surrounding the insulating tongue portion. The receiving cavity is divided into a housing receiving portion for receiving the insulating tongue portion of the counter connector and a shell receiving portion for receiving the shielding member. The detecting pin has an arc section projecting only into the shell receiving portion of the receiving cavity.

2 Claims, 11 Drawing Sheets

ELECTRICAL CONNECTOR WITH AN IMPROVED DETECTING PIN

BACKGROUND OF THE INVENTION

1. Field of the invention

The present invention relates to an electrical connector having a detecting pin.

2. Description of Related Art

U.S. Pat. No. 5,674,085 discloses an electrical connector having an insulating housing defining a tongue portion, a shielding shell surrounding the housing and conductive terminals in the tongue portion and a detecting pin. The detecting pin is retained in the housing and has a cantilever portion bent and extending below the tongue portion. The cantilever portion will engage with one conductive terminal when a mating connector is inserted into the connector.

However, electrical reliability of the terminals will face challenge since the terminal functions as a detecting pin synchronously. The cantilever is longer so that it might be permanently distorted.

Therefore, an electrical connector with an improved detecting pin is desired to overcome the disadvantages of the related arts.

SUMMARY OF THE INVENTION

An object of the present invention is to provide an electrical connector with an improved detecting pin.

In order to achieve above-mentioned object, an electrical connector includes an insulating housing defining a base portion and a tongue portion extending forwards from a front face of the base portion, a plurality of terminals, a shielding shell and a detect pin. Each contact defines a solder portion extending towards a bottom face of the base portion and a contacting portion located on a first surface of the tongue portion. The shielding shell surrounds the insulating housing and forms a receiving cavity for being inserted by a counter connector with an insulating tongue portion and a shielding member surrounding the insulating tongue portion. The receiving cavity is divided into a housing receiving portion for receiving the insulating tongue portion of the counter connector and a shell receiving portion for receiving the shielding member. The detecting pin has an arc section projecting only into the shell receiving portion of the receiving cavity.

Other objects, advantages and novel features of the present invention will become more apparent from the following detailed description of the present embodiment when taken in conjunction with the accompanying drawings.

DETAILED DESCRIPTION OF THE INVENTION

Figure 1:
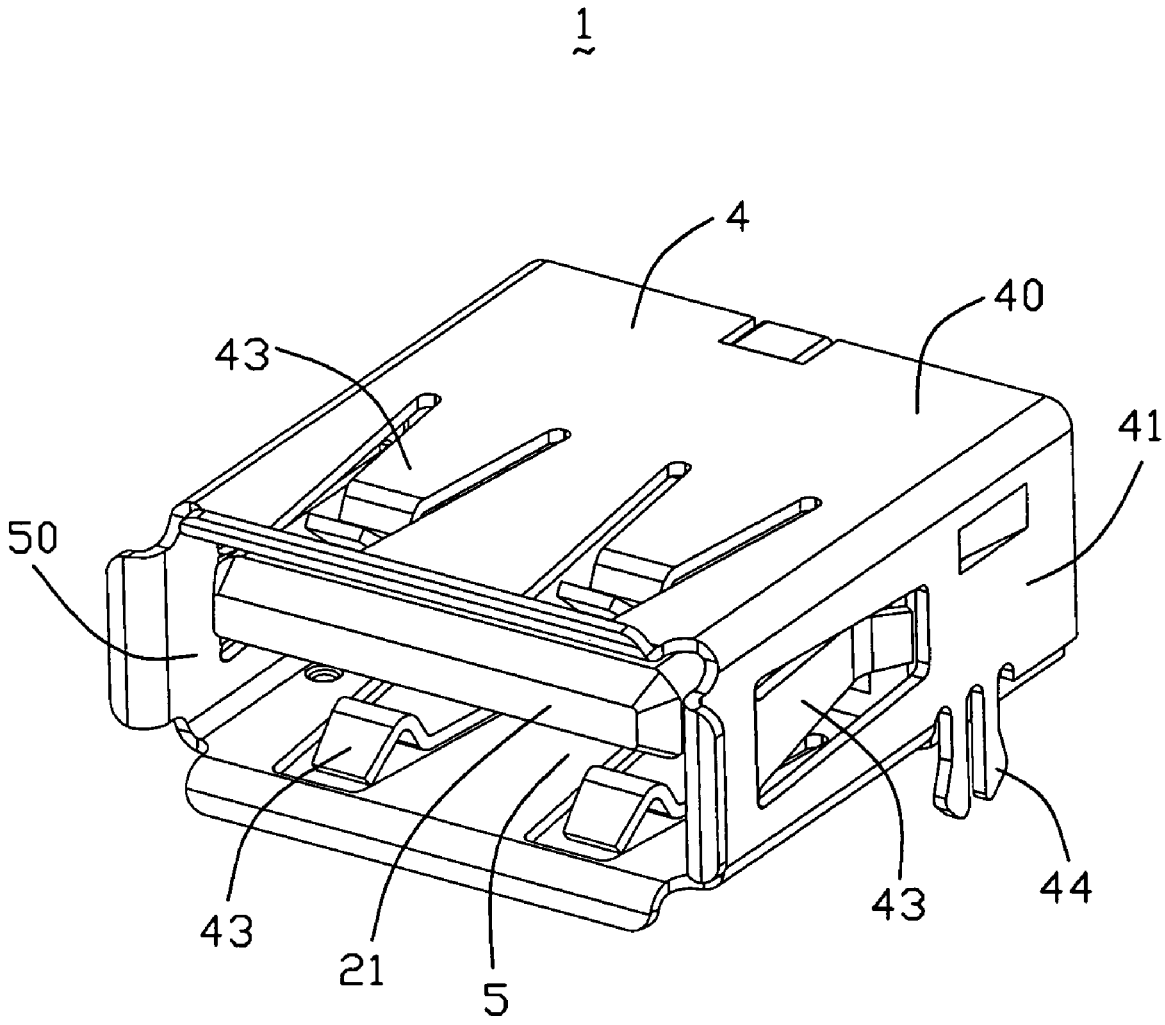
FIG. 1 is a top and front perspective view of an electrical connector of a first embodiment.

Reference will now be made to the drawing figures to describe three preferred embodiments of the present invention in detail.

Figure 2:
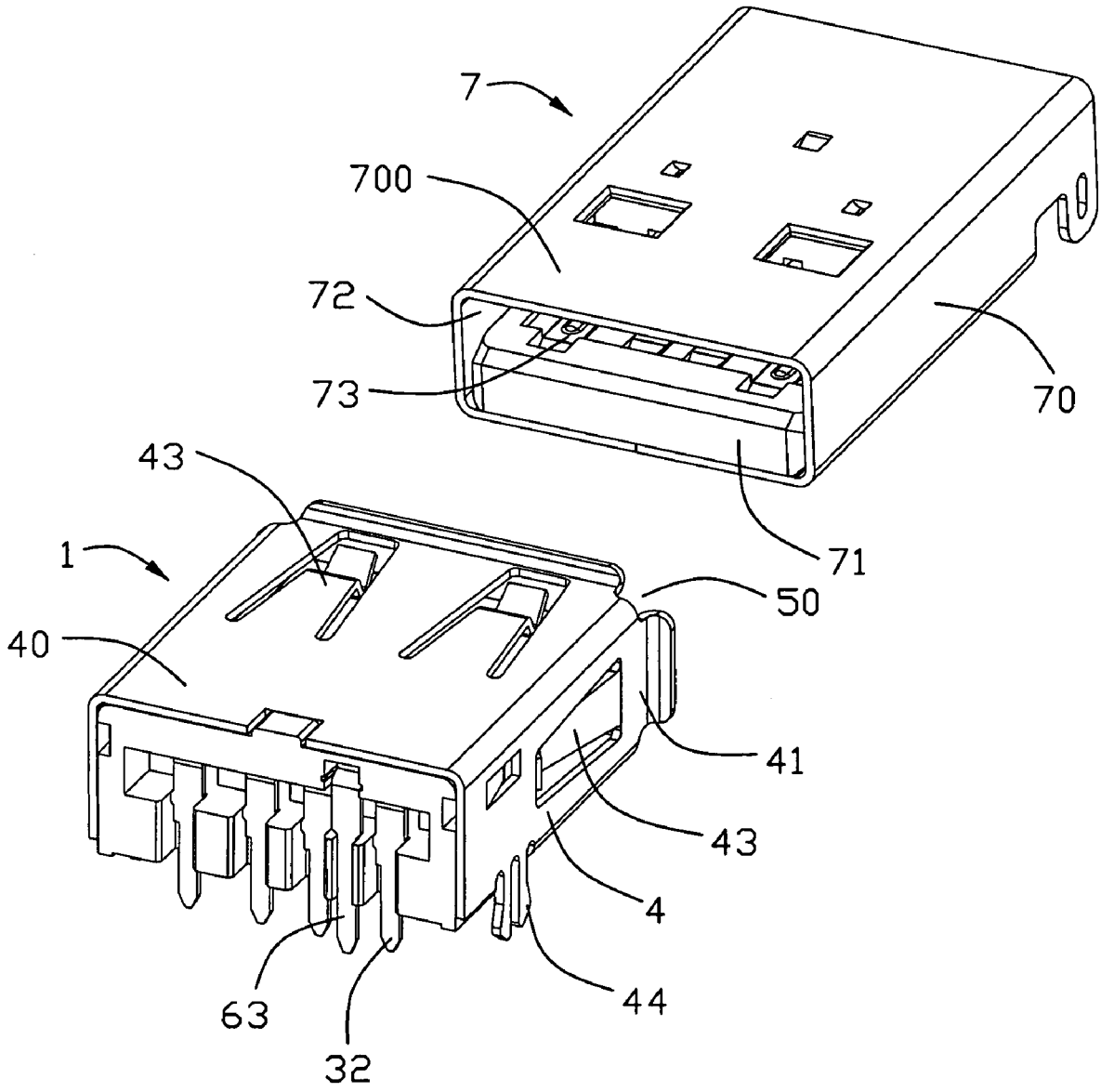
FIG. 2 is a perspective view of the electrical connector and a counter connector.

Referring to FIGS. 1 and 2, an electrical connector 1 of a first embodiment of the present invention is used to mate with a counter connector 7. The counter connector 7 comprises an insulating housing having a front mating tongue portion 71 and a shielding shell 70 surrounding the housing to define a mating cavity between the tongue portion 71, the top wall 700 and sidewalls 72 of the shell 70. A plurality of terminals 73 are arranged on the top surface of the tongue portion 71.

Figure 4:
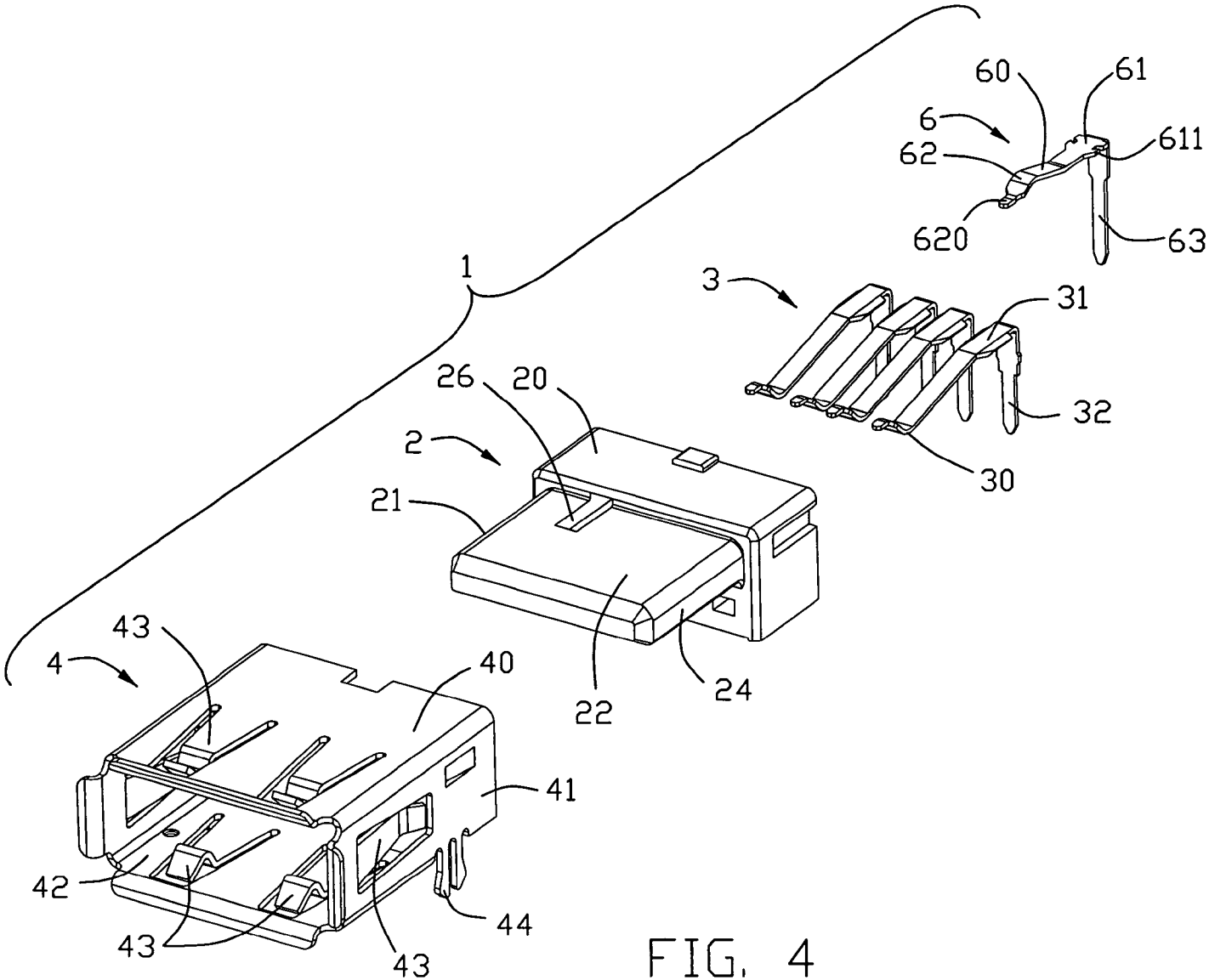
FIG. 4 is an exploded perspective view of the electrical connector shown in FIG. 1.
Figure 6:
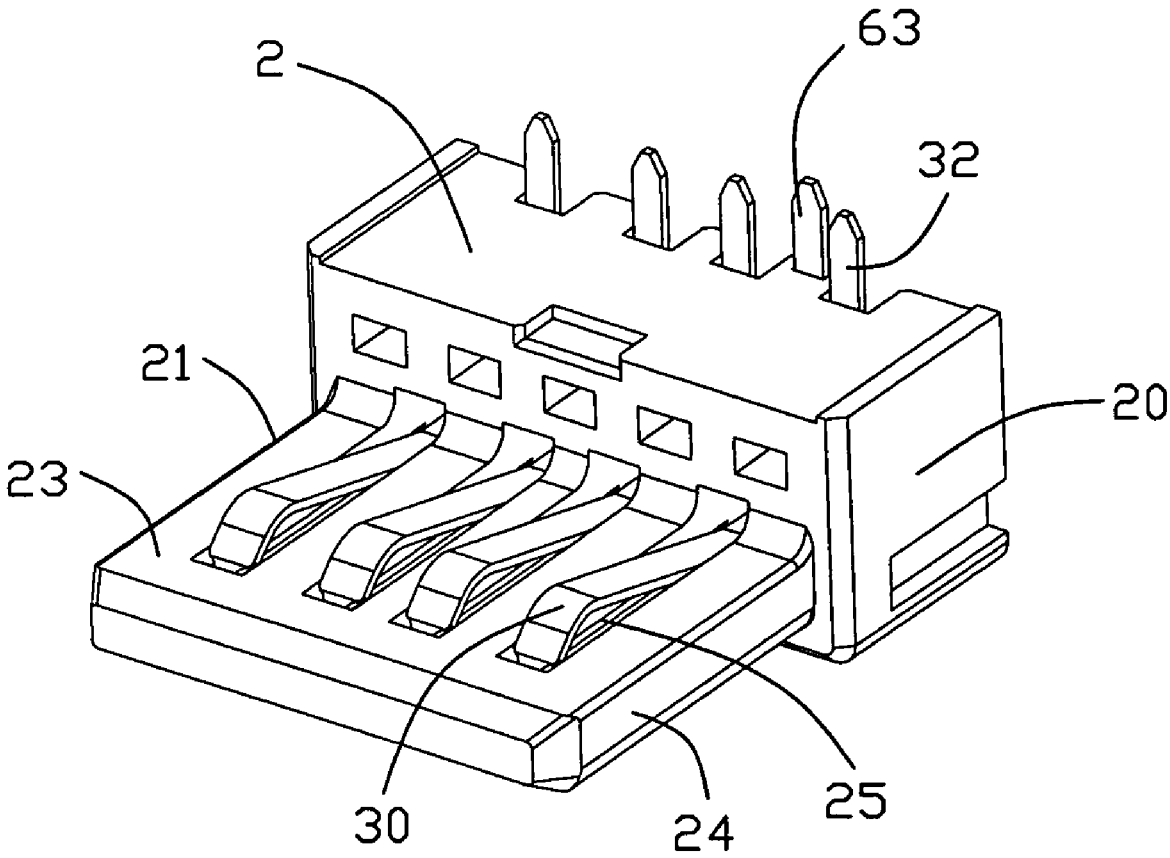
FIG. 6 is a bottom perspective view of the connector without the shell thereon shown in FIG. 1.

Referring to FIG. 4, the electrical connector 1 comprises an insulating housing 2, a plurality of terminal 3, a shielding shell 4 and a detecting pins 6. The insulating housing 2 made from resin material, comprises a base portion 20 and a tongue portion 21 extending forward from a front face of the base portion. The tongue portion defines a top surface 22, a bottom surface 23 and two end surfaces 24. The four terminals 3 are retained in corresponding passageways 25 on the bottom surface of the tongue portion as shown in FIG. 6 and each comprises a retaining portion 31 retained in the base portion, a solder portion 32 extending downwards from the retaining portion and a contacting portion 30 extending forward from the retaining portion. The shielding shell 4 surrounds and is retained on the base portion 20 and spaced surrounds the tongue portion 21 to define a receiving cavity 5 with a mating opening 50 as shown in FIG. 1. The shell comprises a top wall 40, a bottom wall 42 and two sidewalls 41 perpendicularly connecting with the top and bottom wall to commonly define said receiving cavity 5. The top wall, sidewalls and bottom wall respectively define inward spring portions 43. A fork retaining leg 44 extends downward from the bottom of each sidewall 41.

Figure 5:
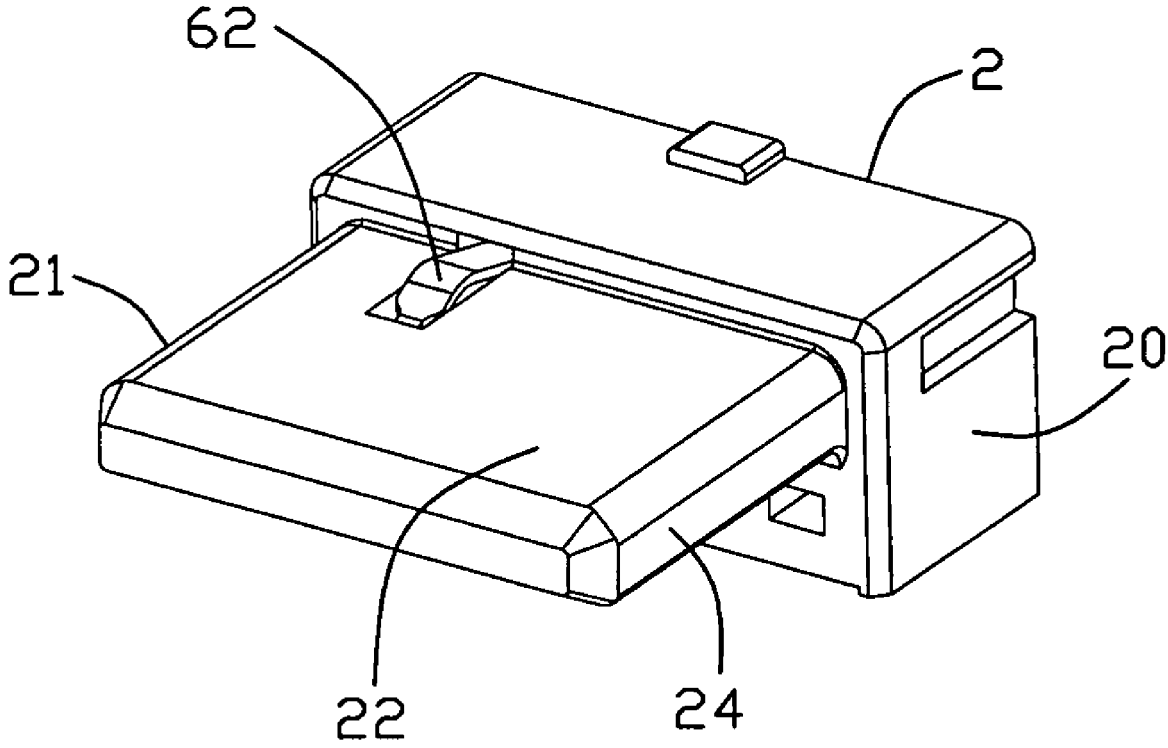
FIG. 5 is a top perspective view of the connector without the shell thereon shown in FIG. 1.

The top surface 22 of the tongue portion 21 defines a groove 26 opening upwards and extending rearward through the base portion 20. The connector 1 further comprises a detecting pins 6 retained in the groove 26. The detecting pin 6 comprises a retaining section 61 with at least one tab at side edges of the retaining section, a leg portion 63 extending downward from a rear end of the retaining section and a contacting arm 60 extending forwards from front end of the retaining section 61. An upwardly arc section 62 is formed at the front portion of the contacting portion 60 and a stopping section 620 is formed at the free end of the contacting arm with a parallel structure. As shown in FIG. 5, the detecting pin 6 is received in the groove 26 and the arc section 62 projects beyond the top surface 22 of the tongue portion 141.

Figure 3:
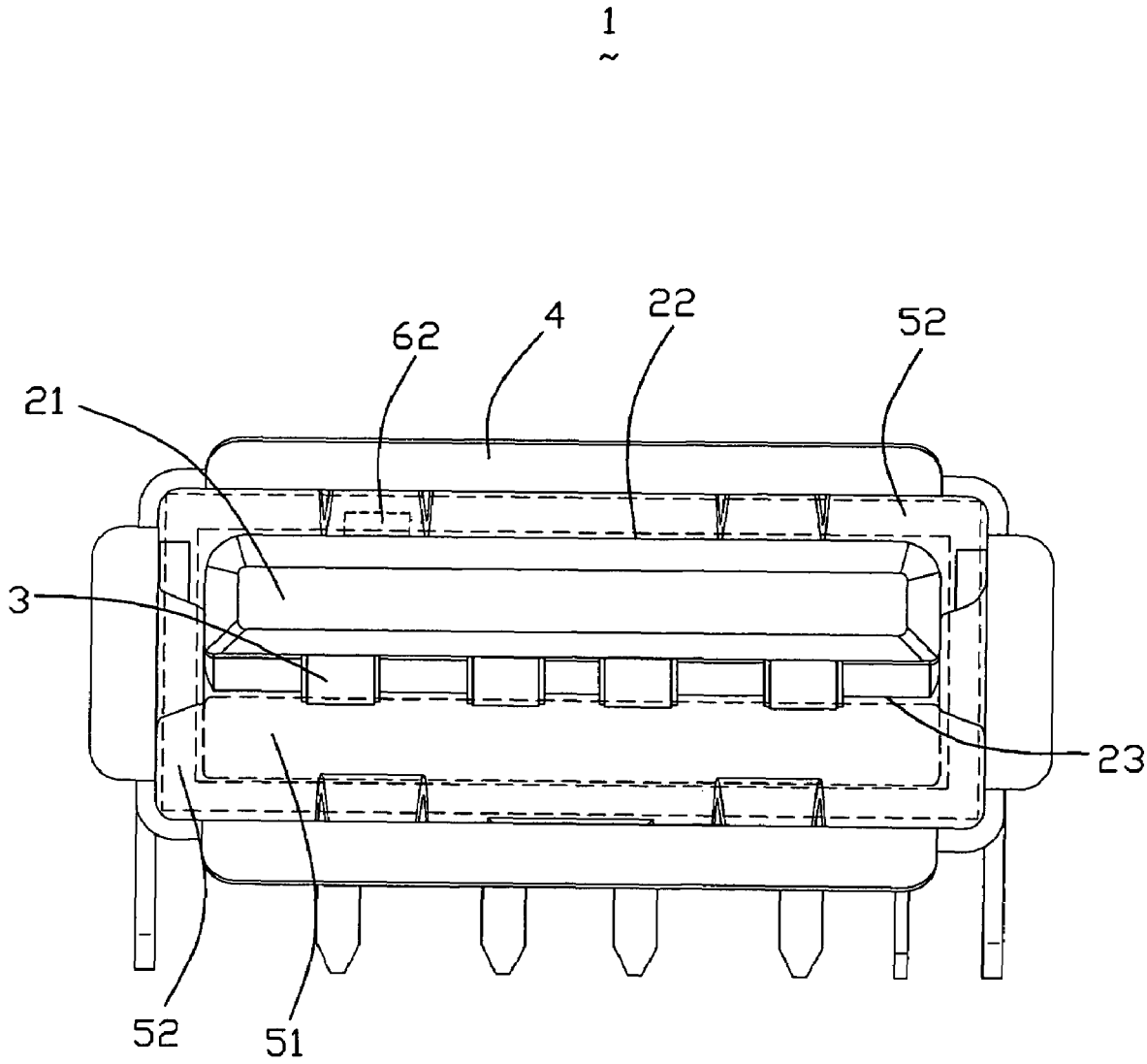
FIG. 3 is a front elevational view of the electrical connector shown in FIG. 1.

As shown in FIG. 3, the receiving cavity 5 is divided in two portions, one is below the bottom surface 23 of the tongue portion 21 for receiving the mating tongue portion 71 of the counter connector 7, which is designated as a housing receiving portion 51, another is around the tongue portion 21 and the housing receiving portion 51 with rectangular ring structure for receiving the shielding shell 70 of the counter connector 7, which is designated as a shell receiving portion 52. The arc section 62 of detecting pin 6 projects into the shell receiving portion 52 of the receiving cavity, which will engage with an inside of the top wall 700 of shell 70 of the counter connector 7 to complete an electrical connection. The height between the top surface 22 of the tongue portion and the top wall 40 of the shell is smaller than that between the bottom surface of the tongue portion and the bottom wall 42 of the shell, thus the shielding shell 52 is only used for receiving the shell 7.

Figure 7:
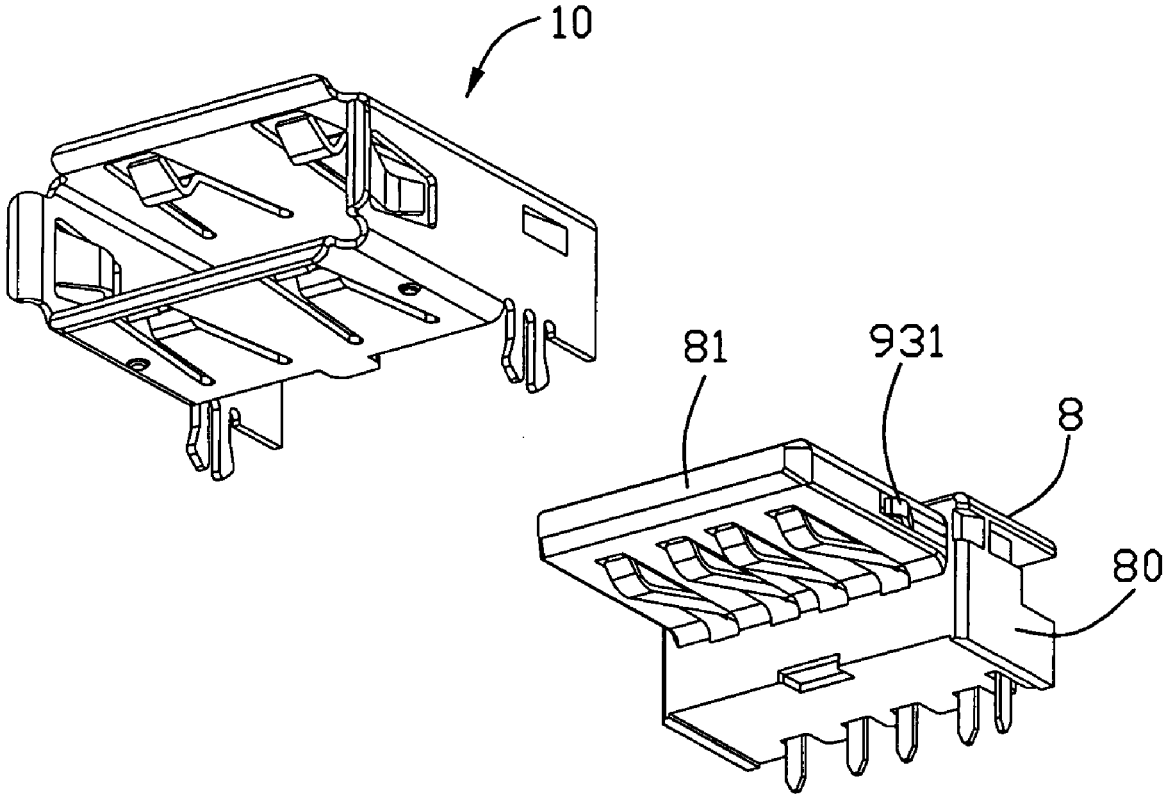
FIG. 7 is an exploded perspective view of an electrical connector of a second embodiment.
Figure 8:
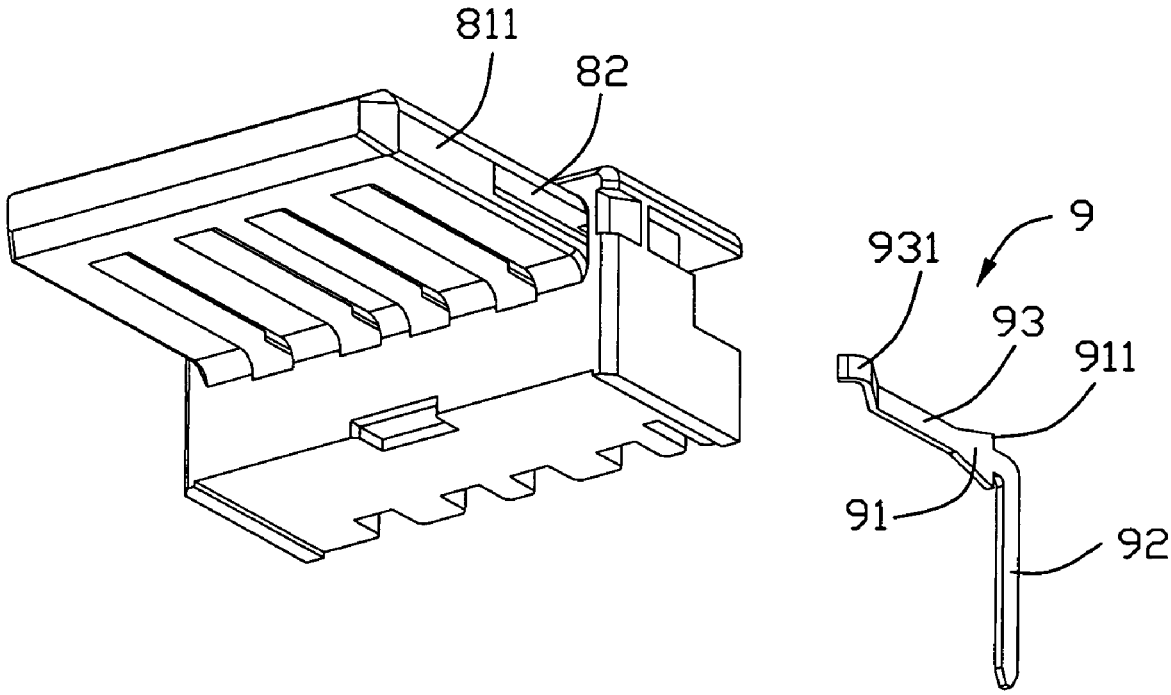
FIG. 8 is an exploded perspective view of the connector without the shell thereon shown in FIG. 7.

Another embodiment of an electrical connector is provided in FIGS. 7 and 8. An insulating housing 8 of the electrical connector comprises a base portion 80 and a tongue portion 81 extending forward from the front surface thereof adjacent to the top thereof. The tongue portion 81 of the housing defines a recess portion 82 at one end wall 811 into which the detecting pin 9 is inserted. The detecting pin 9, made from a metal slit tape and received in the recess portion 82, comprises a retaining section 91, a leg portion 92 extending downwards from the retaining section and a contacting arm 93 from the retaining section. The retaining section has at least one tab 911 at an upper and lower edge thereof and retained in the base portion of the housing. The contacting arm 93 defines an outwards-projecting arc shaped contacting section 931 at a front end thereof and the contacting section 62 projects outwards beyond the end wall 82 of tongue portion and toward the sidewalls of the shell.

Figure 9:
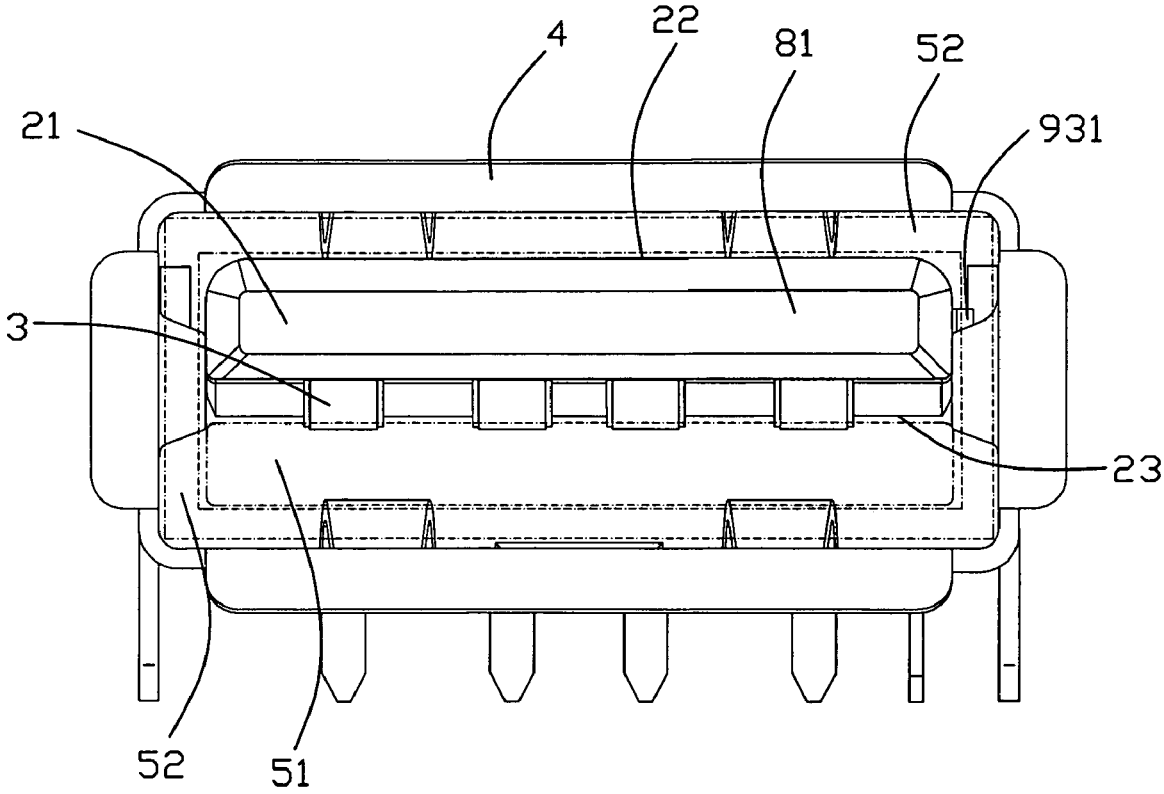
FIG. 9 is an exploded perspective view of the connector of a third embodiment without a shell.

As shown in FIG. 9, the arc section 931 projects into the side portion of the shell receiving 52, which is different from the arc section 62 projecting into the top portion of the shell receiving potion 52 of the first embodiment.

Figure 10:
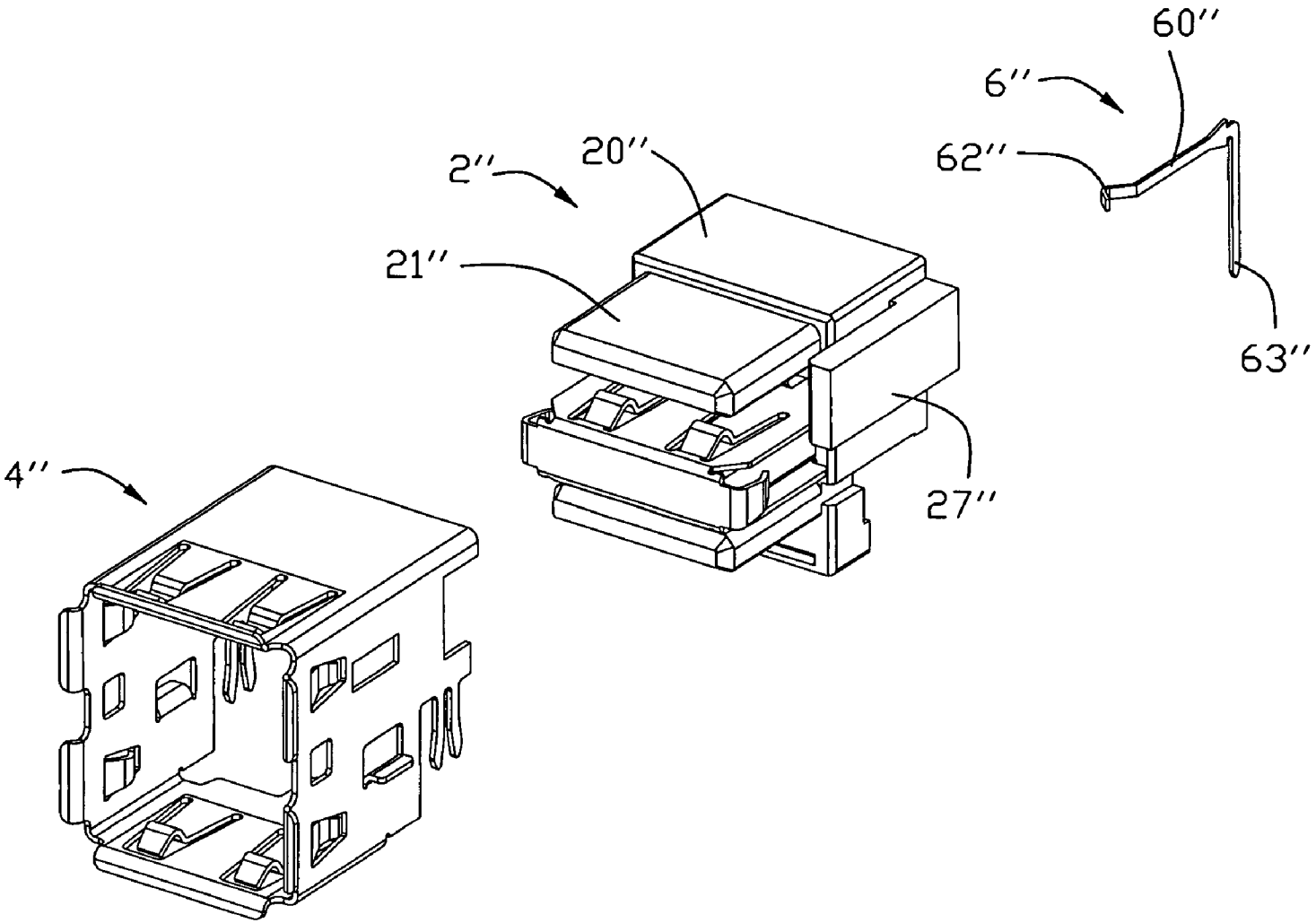
FIG. 10 is a perspective view of the connector shown in FIG. 9.
Figure 11:
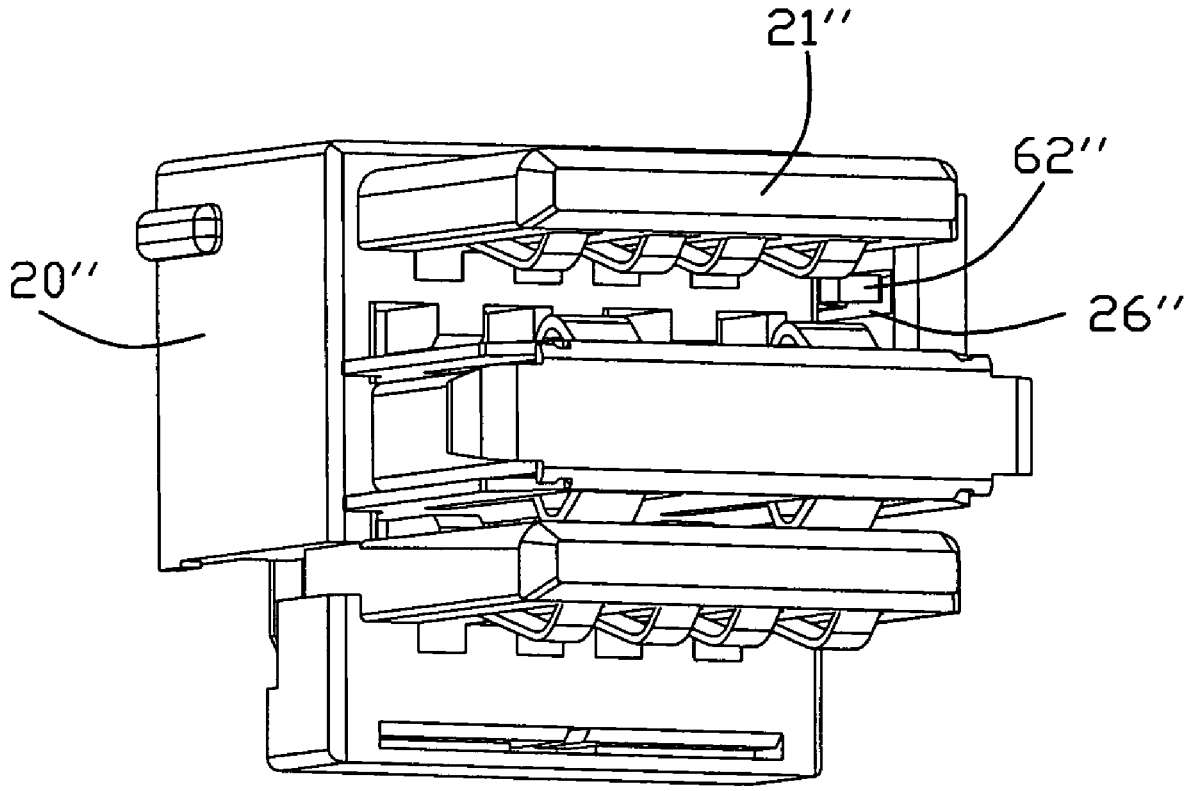
FIG. 11 is a front elevational view of the electrical connector of the second embodiment.

A third embodiment is shown in FIGS. 10 and 11. The electrical connector is a stacked connector which is provided for insertion of two counter connectors. The insulating housing 2" has an upper tongue portion 21" extending from the base portion 20" and a flange portion 27" spaced extending from two opposite ends of the base portion 20". The detecting portion 6" has a contacting arm 60" with an arc section 62" at the distal end of the contacting arm and a solder leg 63". The contacting arm 60" is received in a recess portion 26" in the inner side of the flange portion 27". The arc section 62" projects into the side portion of the shell receiving portion, which is similar to the second embodiment.

However, the disclosure is illustrative only, changes may be made in detail, especially in matter of shape, size, and arrangement of parts within the principles of the invention.

What is claimed is:

1. An electrical connector comprising:

an insulating housing defining a base portion and a tongue portion extending forwards from a front face of the base portion;

a plurality of terminals, each defining a solder portion extending towards a bottom face of the base portion and a contacting portion located on a first surface of the tongue portion;

a shielding shell surrounding the insulating housing and forming a receiving cavity for being inserted by a counter connector with an insulating tongue portion and a shielding member surrounding the insulating tongue portion, the receiving cavity being divided into a housing receiving portion for receiving the insulating tongue portion of the counter connector and a shell receiving portion for receiving the shielding member; and a detecting pin comprising an arc section projecting only into the shell receiving portion of the receiving cavity, wherein the housing receiving portion is located adjacent to the first surface of the tongue portion while the shell receiving portion is located at a periphery of a second surface opposite to the first surface of the tongue portion and the housing receiving portion, wherein the arc section is located on the second surface of the tongue portion, wherein the arc section of the detecting pin is located at one end wall of the tongue portion, wherein the end wall defines a recess portion and the detecting pin is received in the recess portion, wherein insulating housing defines a flange portion extending from the base portion and the flange portion defines a recess portion in an inner face thereof, the detecting pin is received in the recess portion.

2. The electrical connector as described in claim 1, wherein the receiving cavity is located between the tongue portion and the shielding shell.

* * * * *